United States Patent [19]

Boisseau

[11] Patent Number: 4,995,784

[45] Date of Patent: Feb. 26, 1991

[54] PROCESS FOR BREAKING AND REMOVING A TIE SURROUNDING A BUNDLE

[75] Inventor: Jean L. Boisseau, Bucheres, France

[73] Assignee: Vega Automation, Saint Luc, France

[21] Appl. No.: 372,897

[22] Filed: Jun. 28, 1989

[30] Foreign Application Priority Data

Jun. 29, 1988 [FR] France ..... 8808745

[51] Int. Cl.[5] ..... B65B 69/00

[52] U.S. Cl. ..... 414/786; 414/412; 83/20; 83/176; 83/909; 29/33.52

[58] Field of Search ..... 414/403, 411, 412, 627, 414/931, 786; 29/33.52, 564.3; 83/20, 109, 152, 171, 176, 909

[56] References Cited

U.S. PATENT DOCUMENTS

| | | | |
|---|---|---|---|
| 4,348,801 | 9/1982 | Dumont et al. | 29/564 |
| 4,404,723 | 9/1983 | Ohba et al. | 29/33.52 |
| 4,557,659 | 12/1985 | Scaglia | 414/627 |
| 4,586,232 | 5/1986 | Ohmura et al. | 29/33.52 X |
| 4,838,751 | 6/1989 | Hanaya et al. | 414/412 |

FOREIGN PATENT DOCUMENTS

| | | | |
|---|---|---|---|
| 0014698 | 1/1962 | European Pat. Off. . | |
| 0195471 | 9/1986 | European Pat. Off. . | |
| 0100990 | 3/1987 | European Pat. Off. . | |
| 0240289 | 10/1987 | European Pat. Off. | 414/412 |
| 0248715 | 12/1987 | European Pat. Off. . | |
| 0251414 | 1/1988 | European Pat. Off. . | |
| 2336305 | 7/1978 | France . | |
| 2417436 | 9/1979 | France . | |
| 2428575 | 5/1981 | France . | |
| 2415580 | 11/1981 | France . | |
| 2591997 | 6/1987 | France . | |
| 0009137 | 1/1989 | Japan | 414/412 |
| 0045233 | 2/1989 | Japan | 414/411 |
| 0099933 | 4/1989 | Japan | 414/411 |
| 0111644 | 4/1989 | Japan | 414/412 |
| 2076355 | 12/1981 | United Kingdom . | |
| 8703556 | 7/1987 | World Int. Prop. O. | 414/412 |

*Primary Examiner*—Frank E. Werner
*Assistant Examiner*—John Van den Bosche
*Attorney, Agent, or Firm*—Hill, Van Santen, Steadman & Simpson

[57] ABSTRACT

A process and device for breaking and removing a tie which surrounds a bundle of blanks and is arranged in a vertical plane characterized by an arrangement for holding the bundle and transporting it between a first location and a second location, an arrangement for creating a space between an upper surface of the bundle and each of the ties, an arrangement for breaking the ties being inserted in the space to engage the tie and to hold the tie after it has been transversely broken to allow the blanks to be deposited at the second location.

10 Claims, 6 Drawing Sheets

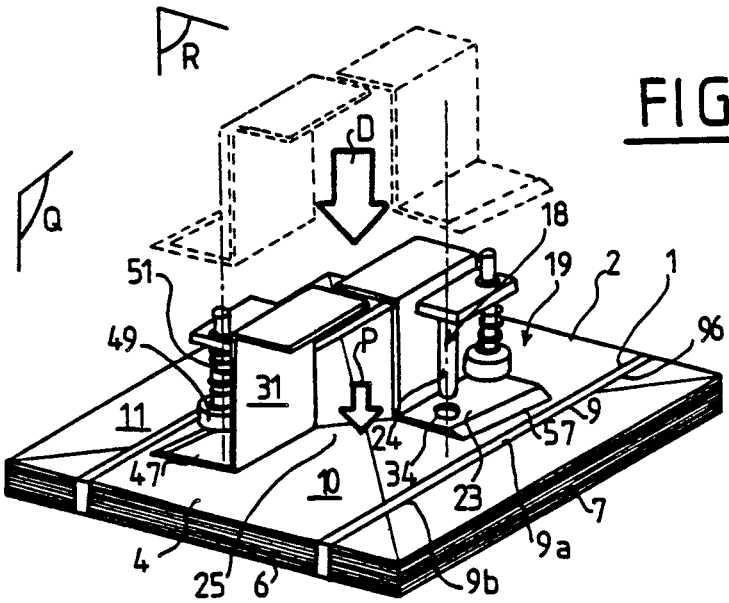
FIG.4
FIG.9
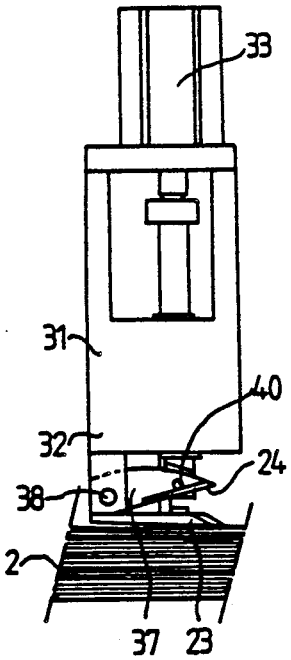
FIG.10
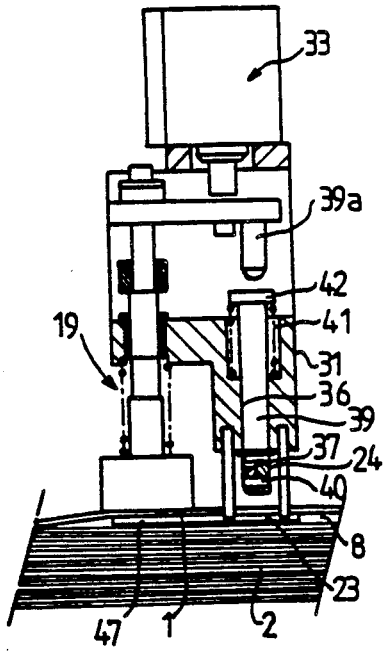
FIG.11
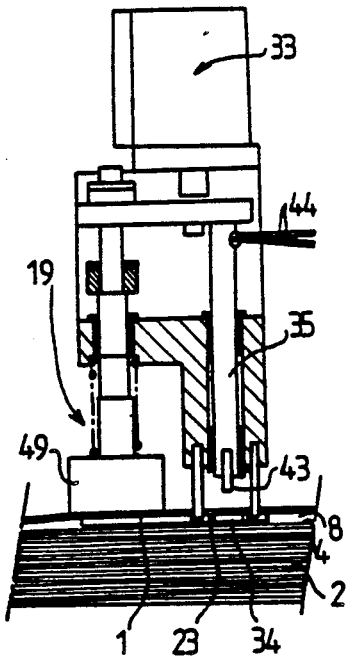

PROCESS FOR BREAKING AND REMOVING A TIE SURROUNDING A BUNDLE

FIELD OF THE INVENTION

The invention relates to a process and a device for breaking and removing a tie surrounding a bundle and to a process and an apparatus for the feeding of blanks using this process and this device.

PRIOR ART

Processes and devices for breaking and removing a tie surrounding a bundle are already known. In the document FR No. 2,336,305, the vertical wires retaining a bale of paper pulp are cut by being melted with electrical energy. The bale, once released, is transported resting on a discharge conveyor. In the document FR No. 2,415,580, a hooping band is cut by means of shears lengthened by a wedge-shaped extension intended for becoming between the hooping band and the bundle, whilst the hooping band is removed by means of an assembly comprising two opposing driving rollers, the bundle resting on a conveyor and the hooping band being cut into portions of small length in proportion as it is removed. In the document FR No. 2,417,436, the upper horizontal ties of a parallelepipedic bale resting on a conveyor are cut by means of shears, the teeth of which penetrate into the bale, and the cut ties are removed by means of movable hooks. In the document FR No. 2,428,575, the bindings of a sheet-metal roll are removed by means of a cutting device striking the binding and of a separate removal device. In the document FR No. 2,591,997, the horizontal hoops of bales are separated by means of vertical shears penetrating into the bale, opposite which are needle means which form a journal and onto which the open hoops are wound. In the document EP No. 14,698, a horizontal tie surrounding a palletized load resting on a table is cut by means of a severing unit associated with a unit for the suction of the severed tie. In the document EP No. 100,990, a band surrounding a bundle is cut by means of a circular cutting tool penetrating into the bundle in parallel with this. In the documents EP Nos. 195,471, 240,289 and 251,414, a horizontal hooping band of a palletized load is cut and removed by means of a device which cuts the band and by means of a movable member, such as a roller. In the document EP No. 248,715, the ties surrounding reels and bundles of metal sheets are severed by means of localized heating. In the document U.S. Pat. No. 4,348,801, the ties of a paper bale are lifted and recovered. In the document GB No. 2,076,355, a band surrounding a bundle of paper sheets is removed.

However, none of the processes and devices thus mentioned can be used for a bundle of products to be preserved, such as packaging blanks, which, once the tie has been released, can come loose, but, on the one hand, must be preserved intact, and, on the other hand, has to be handled in order to be accommodated in a magazine, into which introduction takes place from above. These circumstances arise with stacked packaging blanks intended for filling one or more magazines of a packaging machine or installation. In this case, the procedure hitherto has usually been at least partially manual, the handling of the blank bundle, the cutting of the tie and its removal being separate operations. In such a case, it is not possible to strike the bundle or use shears penetrating into the bundle. Once the bundle is released from the tie, it must still be possible to handle it in the appropriate way, particularly in order to accommodate it in a magazine. Since the bundle is light, of the order of only a few kilograms, it is not possible to exert on it high forces which would have the effect of shifting it out of place. Moreover, it is impossible to use complex systems with a low operating speed which are unsuitable for such a case where the rates are high.

SUMMARY OF THE INVENTION

An intermediate object of the invention is, therefore, to provide a process and a device for breaking and removing a tie of a bundle, which can be used in this particular instance, and the final object of the invention is to provide a process and an apparatus for the feeding of blanks, corresponding to this particular instance, as encountered in the packaging industry and using this process and this device.

To achieve this, the invention relates first to a process for breaking and removing a tie surrounding a bundle and arranged in a vertical plane, by means of a device comprising means for holding the bundle, means for the transverse breaking of the tie, means for holding the tie, and means for removing the broken tie from the bundle, in which, in succession, the bundle is held, the tie to be broken and removed and the breaking means are brought into the vicinity of one another for the purpose of their interaction, the breaking means are activated in order to break the tie transversely, and the tie thus broken and the bundle are separated by the means for holding and removing the tie, wherein, in combination, the tie is broken in its or in an upper part, and, in order to separate the tie thus broken and the bundle, simultaneously on the one hand the tie is held at the location of or in the vicinity of this part and on the other hand the bundle ceases to be held, so that the bundle, subjected only to its own weight, falls, thereby separating from the broken tie.

The invention subsequently provides a device for breaking and removing a tie surrounding a bundle and arranged in a vertical plane, comprising means for holding the bundle, means for the transverse breaking of the tie, means for holding the tie, and means for removing the broken tie from the bundle, wherein, on the one hand, the means for holding the bundle are means for holding the bundle suspended from above, which are either in an active state in which they hold the bundle or in an inactive state in which they do not hold the bundle, and, on the other hand, the means for removing the broken tie from the bundle are composed of the means for holding the bundle suspended, which pass from the active state to the inactive state and which are located above a free space for the fall of the bundle.

BRIEF DESCRIPTION OF THE DRAWINGS

The other characteristics of the invention will emerge from the following description, with reference to the accompanying drawings in which:

FIG. 4 is a partial perspective view illustrating the device according to the invention, on the one hand (unbroken lines) near to a bundle and on the other hand (broken lines) distant from this.

FIGS. 9 and 10 are two partial diagrammatic views of another alternative version of a breaking means in elevation and in vertical section.

FIG. 11 is a diagrammatic view of another alternative version of the breaking means in vertical section.

DESCRIPTION OF THE PREFERRED EMBODIMENTS

Figure 1A:
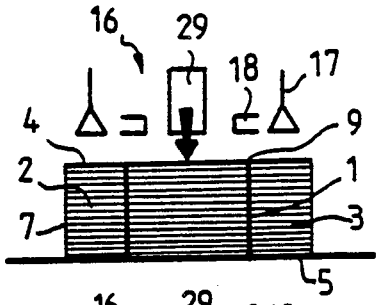
FIGS. 1A to 1E are six diagrammatic elevation views illustrating successive steps of the process according to the invention.

The subjects of the invention are a process and a device for breaking and removing a tie 1 surrounding a bundle 2 and a process and an apparatus for the feeding of blanks 3 using this process and this device.

The bundle 2 of blanks 3 which is surrounded by a tie 1 does not in itself form the subject of the invention. However, a description of the characteristics of the bundle 2 will make it possible to understand the invention more clearly.

In a preferred use of the invention (the instance shown in the Figures), the bundle 2 is heavy and is composed of a plurality of superposed identical blanks 3, each plane, thin and produced, for example, from cardboard. The blanks 3 are held together by means of the tie 1 ensuring the cohesion of the bundle 2. The bundle 2 has a general external form limited by a parallelepipedic (or substantially parallelepipedic) contour and is therefore limited by a top face 4, a bottom face 5, both horizontal and respectively upper and lower, and four lateral and vertical faces, respectively front and rear 6 and side 7. The adjectives top, bottom, horizontal, upper, lower, front, rear and vertical refer to a still formed bundle 2 in the normal storage position or intended to be used. It is this position which will be considered hereafter, without any other specific detail. The lateral faces 6 and 7 are each formed by the superposition of the thickness edges of the superposed blanks 3. The faces 4 and 5 are formed by the top and bottom blanks 3 of the bundle 2.

The tie 1 is elongate, flexible, substantially inextensible and closed rigidly on itself by mechanical knotting, welding or the like. It is capable of being broken transversely under the effect of an external action, such as cutting, heating or the like, especially suitable for its particular nature. It can be composed of a narrow plastic band or a metal strip or a cord. In general terms, the tie 1 surrounds the bundle, being arranged in a vertical plane, this adjective likewise relating to the abovementioned normal position of the bundle 2.

Figure 2B:
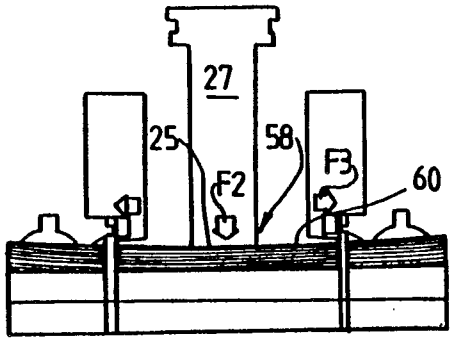
FIGS. 2A to 2D and 3A to 3D are respectively four elevation views and four top views illustrating steps of the process according to the invention and the device.
Figure 2A:
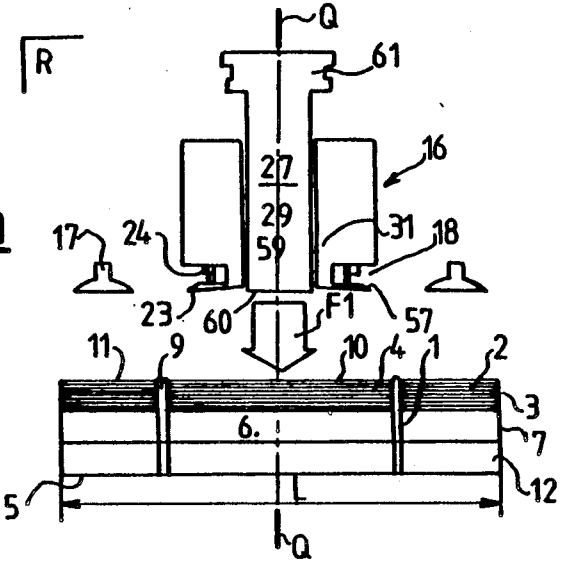

For example, the tie 1 is laid against the top face 4, bottom face 5 and front and rear lateral faces 6 of the bundle 2. There are preferably two ties 1 which are separate from one another and which are arranged in two different planes, especially in two parallel planes set apart from one another. In particular, the two ties 1 are in two vertical planes both set apart from one another sufficiently and set apart from the vertical lateral side faces 7, likewise sufficiently. Also, the two ties 1 are substantially symmetrical relative to a vertical midplane of symmetry Q (see FIG. 2*a*) substantially equidistant from the side faces 7. In the drawings, the reference Q represents both the plane in question and its line in a horizontal or vertical plane. This well-known constructive arrangement of such a bundle 2 is capable of making it possible to achieve its cohesion by means of two ties 1 placed in this way. Thus, if the width L of the bundle 2 defines the distant separating its side faces 7, the spacing between the planes of the two ties 1 is of the order of half the width L, that is to say of the order of L/2, and each tie 1 is at a distance from the nearest side face 7 of the order of L/4.

The tie 1 is tightened on the bundle 2, thus ensuring the cohesion of the latter. However, on the one hand because of the play which necessarily exists between the tie 1 and the blanks 3 forming the bundle 2 and on the other hand because of a certain flexibility or elasticity or deformability of the bundle 2 or of the component blanks 3 of the latter in the vertical direction, it is possible to generate a certain space or transverse spacing in the vertical direction 8 between the tie 1 and the bundle 2 by means of oppositely directed forces exerted vertically o the tie 1 and the blanks 3 respectively (for example, downwards on the blanks 3 and upwards on the tie 1).

Figure 1B:
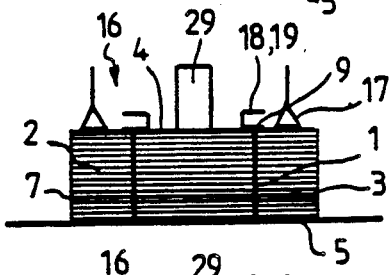
Figure 1C:
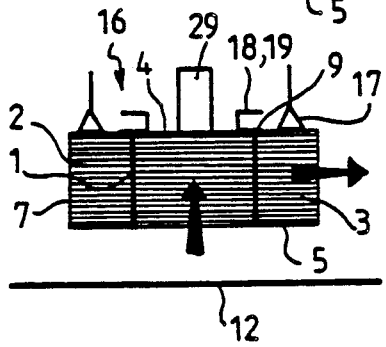
Figure 1D:
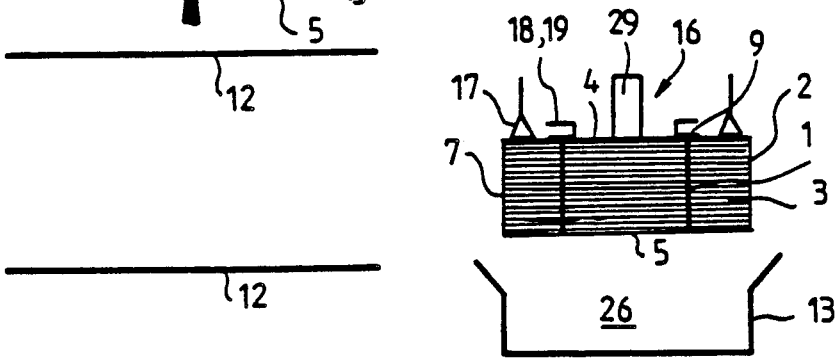
Figure 3A:
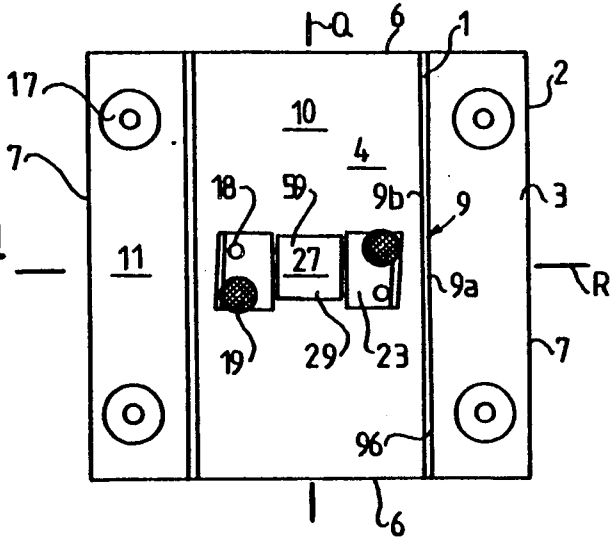
Figure 2D:
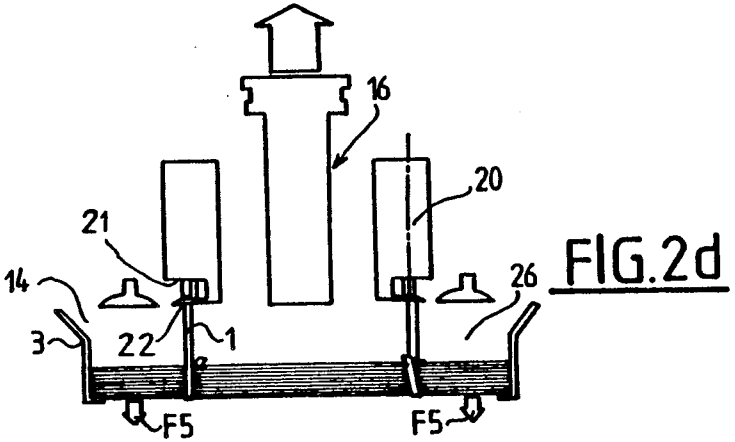
Figure 3D:
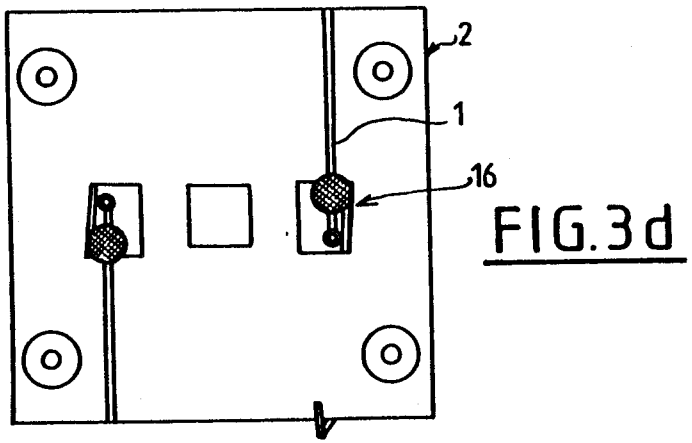
Figure 2C:
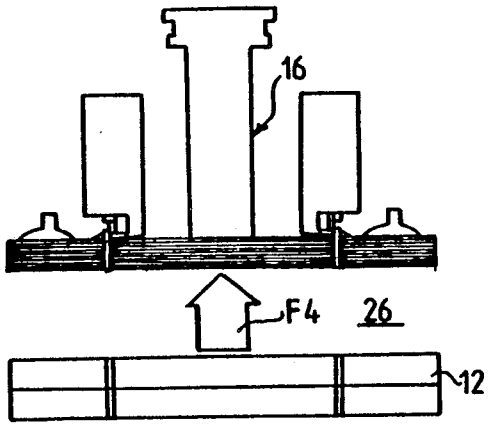
Figure 3C:
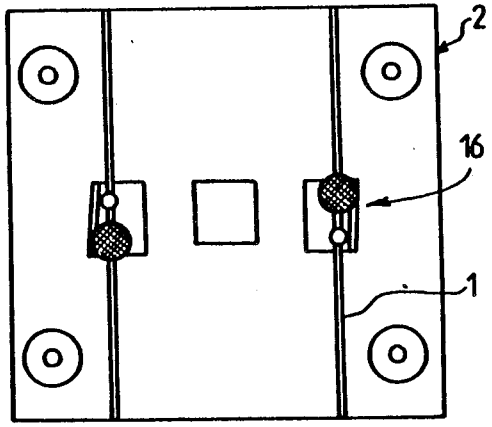
Figure 5:
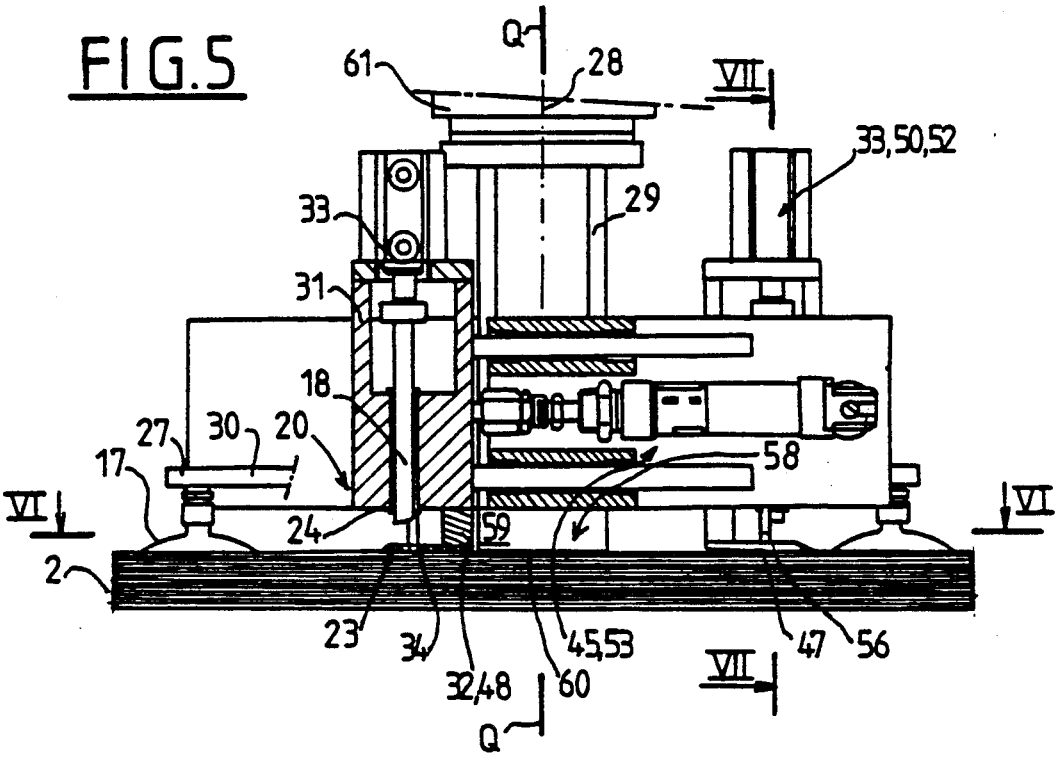
FIG. 5 is an elevation view, partially in a vertical section, of the device according to the invention, in part (right-hand half-view) the tie interacting with the breaking and holding means, and in part (left-hand half-view) the tie being set apart from these.
Figure 6:
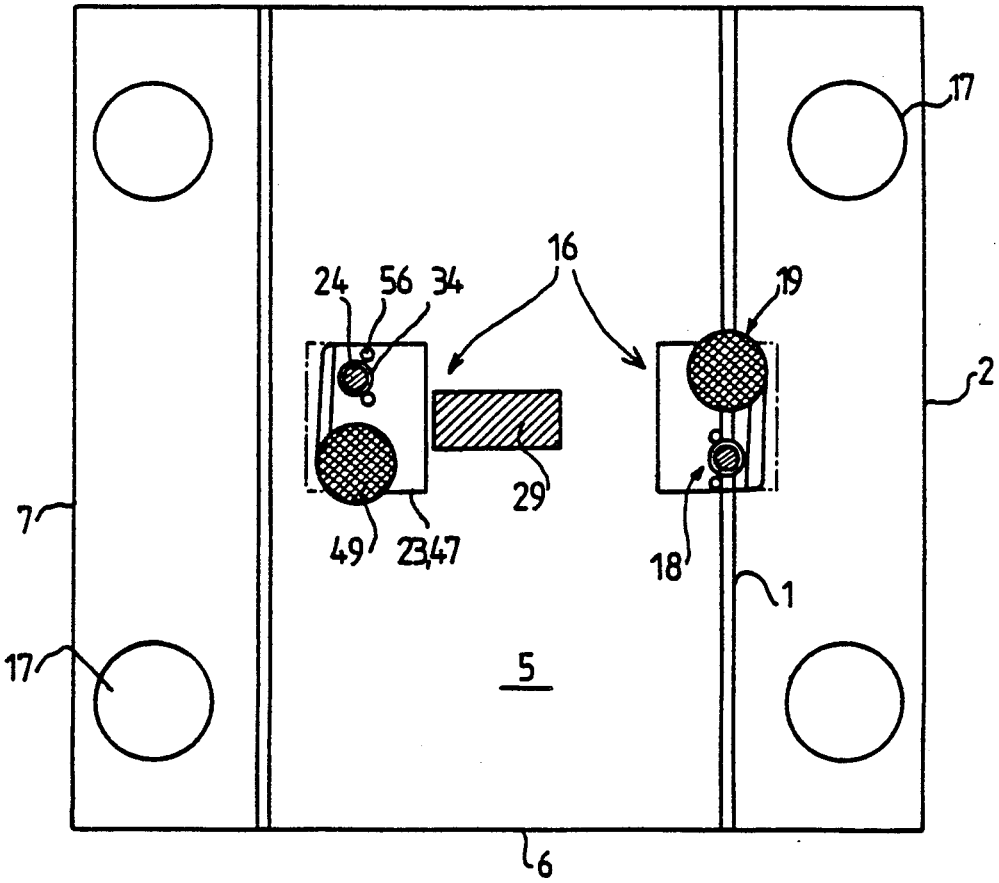
FIG. 6 is a view in horizontal section along the line VI—VI of FIG. 5.
Figure 8:
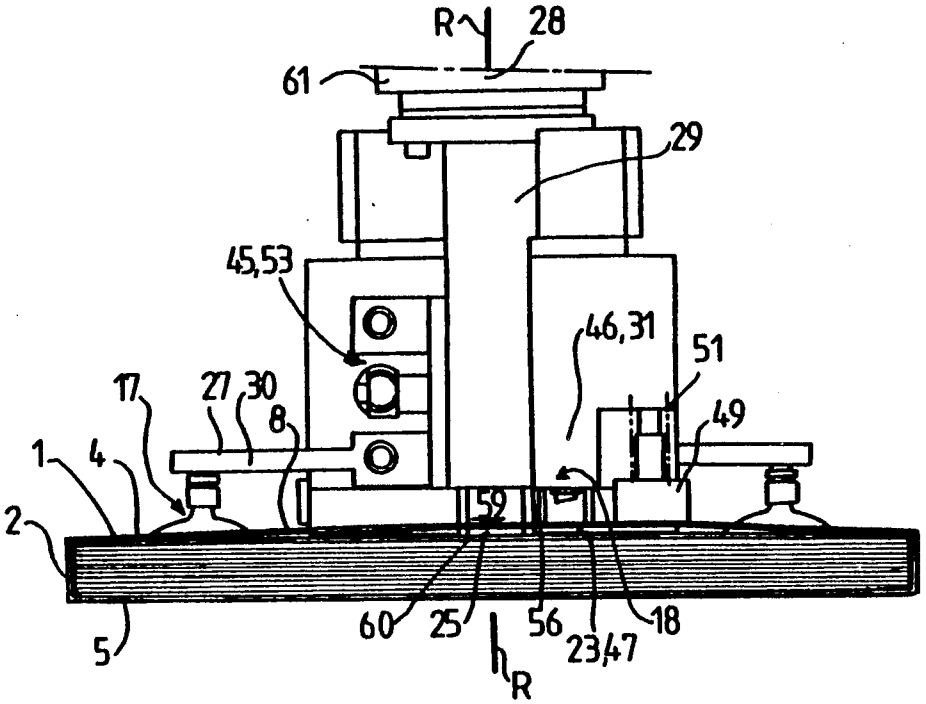
FIGS. 7 and 8 are two diagrammatic views, on the one hand in vertical section along the line VII—VII of FIG. 5 and on the other hand in a side elevation.
Figure 7:
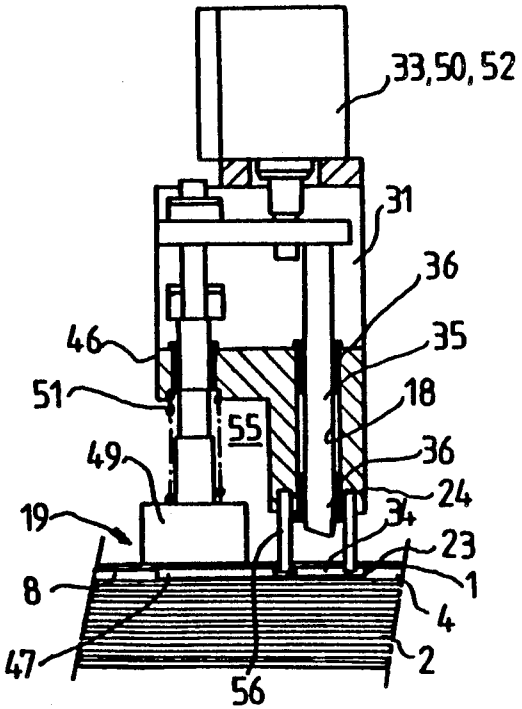

The tie 1, when it is in place, ensures the cohesion of the bundle 2 which thus forms a composite assembly comprising the blanks 3, but constituting a unit capable of being moved, carried and handled in a unitary manner. In particular, the tie 1 is arranged and the bundle 2 formed in such a way that the bundle 2 can be supported by suspension as a result of the holding of the tie 1 in its upper part 9 (see FIGS. 1B–1D). In the structure described here, the upper part 9 of the tie 1 is composed of that portion of the tie 1 against or confronting the top face 4 or of the middle part 9*a* (see FIG. 3*a*) of this portion substantially equidistant from the front and rear faces 6 and near to a vertical plane of symmetry R perpendicular to the plane Q (R designating this plane or the line of the latter in a horizontal plane). The two parts of the upper portion 9 which are arranged on either side of the middle part 9*a* and which are adjacent to the front and rear faces 6 are designated as lateral parts 9*b*.

When the tie 1 is broken transversely, it can be slid at least substantially along itself, so as to be freed from the bundle 2. The blanks 3 forming the latter are then free in relation to one another, being simply superposed on one another.

Such a bundle 2 can be composed, for example, of flat cardboard blanks 3 intended for forming packaging. For example, such bundles 2 can comprise between approximately 10 and 100 superposed identical blanks having, when flat, a format of between (in cm) approximately 10×10 and 100×100 (dimensions of the faces 4 and 5). Such a bundle 2 can have a height (spacing of the faces 4 and 5) of between (in cm) approximately 0.2 and 40. The weight of such a bundle 2 can be, for example, between 200 grams and 20 kilograms.

Such a bundle 2 is in two possible extreme states: a close-packed state in which the tie 1 is tightened on the bundle 2, thus ensuring its cohesion (FIGS. 1A to 1D, 2A, 2B, 2C, 3A, 3B, 3C), and a free state in which the tie 1 is broken transversely and removed completely or partially from the bundle 2, as already described (FIGS. 2D, 3D, 1E, 1F).

Figure 1E:
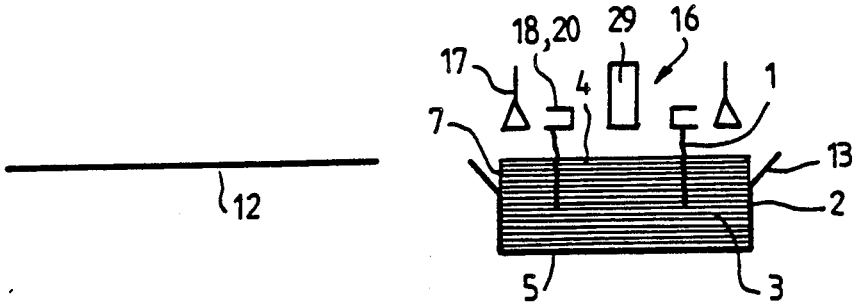
Figure 1F:
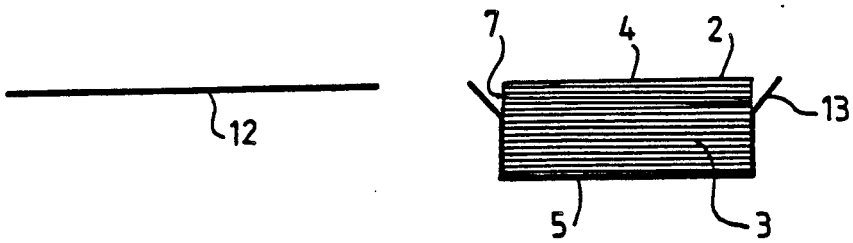
Figure 3B:
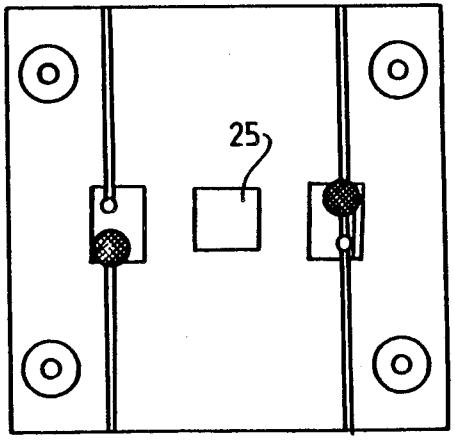

Moreover, such a bundle 2 can be in two extreme locations set apart from one another: a first storage location 12 (FIGS. 1A, 1B) and a distribution location 13 (FIGS. 1E, 1F). In the storage location 12, the bundle 2 is normally in the close-packed state. This situation corresponds to the circumstances where the bundle 2 is not being used and is waiting to be used. In the distribution location 13, the bundle 2 is normally in the free state. This situation corresponds, for example, to the circumstances where the bundle 2 (free of any tie 1) is in a magazine (likewise designated by 13) of a machine, especially a packaging machine. The bundle 2, when it is placed in the magazine 13, has to be clear of the tie 1, because in this location it is impossible or inconvenient to remove the tie 1 owing to the very presence of the magazine 13. A magazine 13, as just mentioned, is known per se in the packaging art and possesses, in particular, an upper loading orifice 14 and an especially lower distribution orifice. It should be noted that the invention also makes it possible to load the magazine 13 of this type which is inclined relative to the horizontal.

The process for breaking and removing the tie 1 employs a device 16 (see FIGS. 1A–1F), described in detail later, comprising means 17 for holding the bundle 2, means 18 for the transverse breaking of the tie 1, means 19 for holding the especially broken tie 1, and means 20 for removing the broken tie 1 from the bundle 2.

It goes without saying that the embodiment of the bundle 2 described is merely indicative and is not in itself liable to limit the scope of the invention. The invention therefore applies both to bundles 2 of different form, composition, type, intended use, etc. and to bundles 2 comprising a different number or a different structure of ties 1, such as, for example, a plurality of ties in different planes, parallel or not, or even ties which intersect, for example in two perpendicular vertical planes, or wider ties 1 in the form of a band or a net.

In the process, in succession, the bundle 2 is held, the tie 1 and the breaking means 18 are brought into the vicinity of one another for their interaction, the breaking means 18 are activated in order to break the tie 1 transversely, and the tie 1 thus broken and the bundle 2 are separated by the means 19, 20 for holding and removing the tie 1.

According to the invention, in combination, the tie 1 is broken in its or in an upper part 9, and, in order to separate the tie 1 thus broken and the bundle 2, simultaneously on the one hand the tie 1 is held at the location of or in the vicinity of this part 9 and on the other hand the bundle 2 ceases to be held, so that the bundle 2, subjected only to its own weight, falls, thereby separating from the broken tie 1, by means of a free space 26 located under the bundle 2 and allowing the vertical descending movement of the bundle 2.

More specifically, the bundle 2 is held suspended from above. In particular, the bundle 2 is held suspended from above by vacuum suction by means of suitable members, and the bundle 2 ceases to be held suspended by stopping the vacuum supply. Alternatively, the bundle 2 can be held by different members, such as grippers.

Depending on the type of tie 1, the latter is broken transversely either mechanically or by cutting, especially by shearing or punching, or by melting. Also, the tie 1 is held by gripping. For this purpose, the tie 1 is made to interact with a gripper 21, and the lower jaw 22 of the gripper 21 is introduced between the tie 1 and the bundle 2 at the location of or in the vicinity of the upper part 9 of the tie 1.

In order to bring the tie 1 and the breaking means 18 into the vicinity of one another for their interaction, a plate 23 forming the jaw 22 and a counterpart to said means 18 and facing the transverse breaking member 24 is introduced between the tie 1 and the bundle 2 at the location of or in the vicinity of the upper part 9 of the tie 1.

In particular, the lower jaw 22 and the plate 23, forming a counterpart, are introduced simultaneously or substantially simultaneously between the tie 1 and the bundle 2. For this purpose, a transverse spacing 8 is obtained between the tie 1 and the bundle 2. As already mentioned, as regards a bundle 2 having some flexibility, this is made possible by action on the bundle 2 in order to give it a certain vertical concave deformation in which the transverse spacing 8 is generated. To achieve this, for example, two oppositely directed forces are exerted on the bundle 2 on either side of the tie 1. For example, the bundle 2 is held suspended locally on one side of the tie 1 and pressure is exerted downwards on the bundle 2 locally on the other side of the tie 1. For the sake of balance and effective retention, the bundle 2 is held suspended locally at several locations defining a suspension polygon, and pressure is exerted downwards on the bundle 2 locally, especially in the middle part of the suspension polygon. Also, in particular, the bundle 2 is held suspended locally and pressure is exerted on the bundle 2 locally at locations set longitudinally apart from one another along the tie 1.

The lower jaw 22 and/or the plate 23, forming a counterpart, are introduced near the location at the exertion of pressure downwards on the bundle 2. For this purpose, the lower jaw 22 and/or the plate 23, forming a counterpart, are first laid against the bundle 2 at a location set transversely apart from the tie 1, and subsequently, once the transverse spacing 8 between the tie 1 and the bundle 2 is obtained, the lower jaw 22 and/or the plate 23, forming a counterpart, are slid transversely in the direction of the tie 1.

The bundle 2 and/or the tie 1 are deformed by acting on them in opposite vertical directions, thus making it possible to obtain the spacing 8. Subsequently, the lower jaw 22 and the plate 23 are made to penetrate into this spacing 8 as a result of horizontal sliding. With the bundle 2 held suspended by a suspension polygon by the means 27, especially on its periphery, action is taken on the bundle at a location set apart from this polygon, hence vertically and downwards approximately at the center of the bundle, the top face 4 from then on forming a dish with a central bottom. As a result of this, the ties 1 become loose at the location of the said dish, that is to say in their part 9, the spacing 8 being generated in this way.

As emerges from the foregoing, the bundle 2 is first grasped at a first storage location 12, subsequently the bundle is moved to a point above, in line with and near a second distribution location 13, and in this position the tie 1 is broken and removed.

According to one characteristic of the invention, the various ties 1 are broken and removed simultaneously where the bundle 2 having several ties 1 is concerned.

Preferably, the bundle 2 is held suspended at its outer periphy near the lateral faces 6 and 7, and pressure is exerted on the bundle 2 in its central zone 25 (at the intersection or in the vicinity of intersection of the lines of the planes Q and R).

In the preferred case of a bundle 2 with two ties 1, the bundle 2 is held by means of the two lateral zones 11 and pressure is exerted on the middle zone 10 of the bundle 2 between the two lateral zones 11, the bundle 2 thus being subjected to two ascending vertical lateral forces and a descending central force, on either side of the ties 1.

It is clear that the notion of a free falling space 26 is only relative, although this corresponds to a preferred exemplary embodiment which has the advantage of making it possible to install the bundle 2, free of the ties 1, in the magazine 13, the bundle 2, subjected to its own weight, coming to rest correctly in the magazine 13 naturally. However, the scope of the invention also includes a case where the bundle 2 does not actually execute a vertical descending fall in the falling space 26, in this case the magazine 13 (or the equivalent) or the device 16 being then slid upwards.

The invention also relates to a process for the feeding of blanks 3 to one or more magazines 13 of a machine, especially a packaging machine, the blanks 3 being stacked horizontally to form one or more bundles 2, each bundle 2 initially being, on the one hand, surrounded by at least one tie 1 arranged in a vertical plane and, on the other hand, situated at a first storage location 12 set apart from the magazine 13, in which the bundle 2 of blanks 3 free of a tie 1 must finally be placed for its subsequent use, the blanks 3 being intended to form containers for the packaging of contents. In this process, a bundle 2 is taken from the storage location 12 and transported in line with the magazine 13 forming a distribution location, and the tie or ties 1 of the bundle 2 of blanks 3 is or are broken and removed by means of the process just described.

Reference will now be made more especially to FIGS. 2 to 8 which illustrate a device 16 according to the invention in more detail.

According to the invention, the device 16 is such that the means 19 for holding the bundle 2 are means for holding the bundle 2 suspended from above, which are either in an active state in which they hold the bundle 2 or in an inactive state in which they do not hold the bundle 2. The means 20 for removing the broken tie 1 from the bundle 2 are composed of the means 17 for holding the bundle 2 suspended, which pass from the active state to the inactive state and which are located above a free space 26 for the fall of the bundle 2, within the meaning mentioned above. The falling space 26 is formed particularly by the space located in line with the magazine 13 and, more especially, by its loading orifice 14.

Thus, according to the invention, the bundle 2 is held suspended from above on the face 4 by the means 17 which are then active. The tie 1 is broken by the means 18 in its upper part 9. Also, the means 19, 20 then hold the broken tie 1 at a single location in its upper part, whilst simultaneously the bundle 2 ceases to be held, the means 17 being brought into the inactive state. In this situation, the tie 1 is still held at a single location by the means 19 and 20, but the bundle 2 on the one hand is no longer held (either directly or indirectly) and on the other hand is located above the falling space 26, the result is that the bundle 2 is subjected only to its own weight and then falls, the tie 1 and the bundle 2 being separated from one another.

The means 17, 20 for holding the bundle and removing the broken tie 1 from the bundle 2 comprise at least one downward-directed vacuum-suction cup associated with vacuum supply means, with which are associated means for controlling the functioning and stopping of the vacuum supply means. In general, the device possesses several suction cups defining the rigid suspension polygon for the bundle 2, the plurality of suction cups being supplied with a vacuum synchronously by the vacuum supply means. This plurality of suction cups is carried via a common support 27 capable of keeping the suction cups in their appropriate position. The suction cups are especially coplanar and of fixed relative position. In particular, there is at least one pair of suction cups set transversely apart to one another (that is to say, parallel to the plane Q) or, preferably, two pairs of suction cups set longitudinally apart from one another (that is to say, symmetrically relative to the plane Q). In the latter case, the suspension polygon can have the form of a square or a rectangle, thus allowing the bundle 2 to be held suspended on its periphery.

If appropriate, the support 2 is adjustable, but lockable, so as to make it possible to adapt the suction cups in dimensional terms to the blanks 3 to be grasped and to the bundle 2 to be held.

Such a structure with a movable support 27 and suction cups controlled in order to pick up a blank 3 is within the scope of an average person skilled in the art in the general sector of packaging. There is therefore no need to describe this structure in more detail.

Reference will now be made more especially to FIGS. 5 to 8 which show the component means 17 of the device 16 in more detail. The device 16 has a vertical general axis 28 and a general plane of symmetry Q and indeed also a plane of symmetry R, the intersection of the planes Q and R defining the axis 28. It goes without saying here, that the device 16 is movable as a whole, as emerges from the preceding description relating to the process, the device 16 passing from the location 12 to the location 13, and vice versa. However, the device 16 preferably keeps the axis 28 generally vertical, so that the blanks 3 are generally horizontal. This situation occurs at least at the moment when the tie 1 is broken, at least if the bundle 2 is to be prevented from coming loose. However, the scope of the invention includes the circumstances where the bundle 2 is not horizontal and the axis 28 is not vertical, either permanently or temporarily. The description is made on the basis of the hypothesis under consideration, the notions of horizontal, etc. relating to the axis 28. As likewise emerges from the foregoing, the device 16 as a whole is placed above a bundle 2. Also, the notions of high, low, upper and lower are taken in relation to the axis 28. In the embodiment illustrated, the support 27 comprises, on the one hand, a central column 29 of axis 28, forming the main supporting part of the device 16, and, on the other hand, horizontal brackets or spars 30 which are fastened rigidly at one of their ends (the inner end) to the column 29, especially to its lower end part, and to which the suction cups are fastened rigidly at the other end (the outer end). The arrangement of the suction cups is matched to the form, especially to the dimensions of the bundle 2 and to the location of the tie or ties 1 on the latter. The suction cups are intended to be laid against the top face 4 at locations free of a tie 1. Putting the suction cups under vacuum causes rigid retention between the suction cup and the bundle 2 with sufficient force to allow the bundle 2 to be held suspended by means of the vacuum. This technique is well-known in principle in the general sector of packaging and therefore need not be described in more detail. It must be emphasized that producing the holding means 17 by means of suction cups 17 makes it possible to prevent damage to the blanks 3.

The means 18 for the transverse breaking of the tie 1 will now be described in more detail. These means are either mechanical means of cutting by shearing or punching or means capable of melting the tie 1, as a function of the type and composition of the tie 1 itself, or any other suitable means.

Such breaking means 18 comprise an upper support 31; a plate 23 forming a counterpart, plane, thin, horizontal and associated rigidly with the support 31 at its lower end 32; a member 24 for the transverse breaking of the tie, movable vertically in the support 31 above and in line with the plate 23 forming a counterpart to the breaking member 24, between an upper inactive set-apart position and a lower active close position, in which the breaking member 24 is respectively vertically set apart from and close to the plate 23 forming a counterpart; means 33 for driving the breaking member 24 between its two positions; and means for controlling the drive means 33. With such breaking means 18, the tie 1 to be broken transversely is placed on the plate 23, forming a counterpart, at the desired location confronting the breaking member 24 controlled so as then to be in the inactive set-apart position. The control means then control the drive means 33 in order to cause the breaking member 24 to move from its inactive set-apart position to its lower active close position. As a result of this movement of the breaking member 24 and consequently its activation, the tie 1 is broken at the location of the breaking member 24 of the means 18.

The drive means 33 can comprise elastic means stressing the breaking member 24 permanently towards its inactive position and/or means for the positive movement of the breaking member, such as a jack, making it possible to cause the breaking member 24 to pass from its inactive position to its active position, and vice versa, as will be seen in detail later. Furthermore, as will likewise be seen in detail later, the breaking member 24 is mounted on the support 31 vertically slideably or pivotably about an axis parallel to the plate 23 forming a counterpart.

According to a first alternative version (FIGS. 5, 7 and 8), the breaking member 24 is a punch interacting with a hole 34 opposite the plate forming a counterpart 23. According to a second alternative version (FIGS. 9 and 10), the breaking member 24 is the cutting edge of shears. According to a third alternative version (FIG. 11), it is a heating device, such as an electrical resistor.

Other alternative embodiments different in structural terms, but producing the same result can be considered.

As regards the first alternative version (FIGS. 5, 7 and 8), the breaking member 24 is the lower end part forming a punch, in combination with the hole 34, of a vertical rod 35 mounted so as to be vertically slideable axially in the support 31 forming a bearing 36. The drive means 33 are composed, for example, of a jack, the rod of which acts on the rod 35 in its upper part, this jack 33 being carried by the support 31 in the upper part of the latter. The control means then act on this jack 33.

Where the second alternative version (FIGS. 9 and 10) is concerned, the breaking member 24 is the cutting edge of shears (or more exactly of a shear jaw 37), mounted in an articulated manner about an axle 38 parallel to the tie 1 and carried by the support 31 at its lower end 32. A vertical control rod 39 mounted vertically slideably in the support 31 forming a bearing 36 is articulated, at its end part, on the jaw 37 by means of an axle 40 parallel to the axle 38. The control rod 39 is carried, for example, by the support 31, with an elastic member 41 interposed between two bearing surfaces 42, this elastic member 41 permanently stressing the jaw 37 (that is to say, the member 24) into the upper inactive set-apart position. According to the first alternative version, the drive means 33 can then have a jack which acts on the rod 39 by means of a coaxial rod 39*a* located above the rod 39, but separate from this.

In the third alternative version (FIG. 11), the structure is substantially the same as that of the first alternative version already described, with the following modifications: an electrical heating resistor 43 is fastened to the lower end part of the rod 35 and is supplied with electrical current in a controlled manner by means of the conductors 44.

According to one characteristic of the invention, such means 18 have the advantage of not damaging the bundle 2.

According to another characteristic, the device 16 also possesses drive means 45 capable of moving the breaking means 18 relative to the means 17 for holding the bundle 2 between a retracted position and a working position in which the means 18 are respectively set transversely apart from and at the location of the tie 1. These drive means 45 are particularly means of horizontal sliding transversely relative to the tie 1. In their retracted position, the means 18 are in the inactive position. In their working position, the means 18 are either in their inactive position, to allow the interaction of the tie 1 by accommodation between the plate 23 and the member 24, or in their active position. These drive means 45, for example, are composed of or comprise a jack interposed between the column 29 and the support or supports 31. Also, associated with a jack 45 are means for controlling said jack.

The means 19 for holding the especially broken tie 1 are now described in more detail.

In particular, these means 19 are of the gripper type having two jaws, between which the tie can be held, and comprise an upper support 46, a stationary lower jaw 47 plane, thin, horizontal and associated rigidly with the support 46 at its lower end 48, an upper jaw 49 displaceably movable in the vertical direction in the support 46 above and in line with the stationary jaw 47, with which the movable jaw 49 can interact, between an upper inactive set-apart position and a lower active close position, in which the movable jaw 49 respectively is set apart from and bears vertically on the stationary jaw 47, means 50 for driving the movable jaw 49 between these two positions, and means for controlling the drive means 50 (FIGS. 7, 8, 10 and 11).

The drive means 50 comprise elastic means 51 permanently stressing the movable jaw 49 in the opposite direction to the stationary jaw 47, and means 52, such as a jack, for the positive movement of the movable jaw between the active and inactive positions, and vice versa.

Furthermore, there are drive means 53 capable of moving the means 19 for holding the tie 1 between a retracted position and a working position where the means 19 are respectively set transversely apart from and at the location of the tie 1.

The means for transverse breaking 18 and the means 19 for holding the tie are arranged in the immediate vicinity of one another and form an integral assembly. For this purpose, the supports 31, 46, the drive means 33, 50 and the control means of the means for transverse breaking 18 and the means 19 for holding the tie are at least partially common, and the plate 23, forming a counterpart, and the stationary jaw 47 are composed of a common sheet, the drive means 45, 53 being common, and the assembly as a whole forming a breaking and tie-holding subassembly. Thus, the movable jaw 49 can take the form of a wide stamp which is carried in the lower end of a vertical rod 54 mounted vertically slideably in the support 31, 46 forming a bearing and which is permanently stressed by a spring 51 up against bearing surfaces of the rod 54 and the support 31, 46. This jaw 49 is located to one side, particularly in the immediate vicinity of the breaking member 24, in the direction of the tie 1.

The drive means 33, such as a common jack, act simultaneously on the rod 35, 39 or 54.

Preferably, the support 31, 46 has an outer recess 55 making it possible to accommodate the stamp forming a jaw 49 in the upper inactive position.

The movable jaw 49 and the breaking member 24 are arranged offset in the direction of the axle 38, in such a way that, when the drive means 33, 50 act on them, the movable jaw 49 first reaches the common sheet 23, 47 (or, more specifically, touches the tie 1 situated at this location), then being in the active position, whilst the movable jaw 49 is still in the inactive position. The movable jaw 49 then remains stationary, that is to say in the active position, as a result of the elastic means, and the drive means 33, 50 then move the movable jaw 49 into its active position.

Of course, the horizontal movements from the retracted position to the working position take place in synchronism in respect of the breaking member 24 and the means for holding the tie 1.

Preferably, the sheet 23, 47 has at least one projection 56 for the transverse locking of the tie 1, the said projection 56 being placed in such a position that the tie 1 locked on this projection 56 is in line with the transverse breaking means 18 and the means 19 for holding the tie. For example, there are two projections 56 on either side of the hole 34 (in the direction of the tie 1).

The sheet 23, 47 is at least substantially in the opening and retaining plane of the suction cups of the means 17 (corresponding to the plane of the top face 4).

As emerges from the foregoing, in structural terms the means 20 for removing the tie 1 are composed of the means 17. The means 17 for holding the bundle 2 become means 20 for removing the tie 1 when in the first place the tie 1 has been broken by the means 18, in the second place the tie 1 is held at one location by the means 19, in the third place the bundle 2 is placed above a free space 26, and in the fourth place when the means 17 (the suction cups) are made inactive (by cutting off the vacuum supply), whilst simultaneously the broken tie 1 is held by the means 19.

Preferably, there is at least one integral assembly of means 18, 19 for each tie 1. In the working position, this assembly is located in the middle part **9*a* of the upper part 9 of the tie, where the space 8 may be largest. For example, the assembly of means 18, 19 is located in or in the vicinity of the plane Q. Where a bundle 2 with two ties 1 is concerned, there is a pair of assemblies of means 18, 19 symmetrical relative to the plane Q or to the axis 28. This assembly or these assemblies of means 18, 19, in their retracted position, are located in the immediate vicinity of the column 29 and, on the contrary, in the working position, are set apart from this, then being located between the column 19 and the suction cups of the means 17**.

To allow the tie 1 to interact with the means 18, 19, that is to say to bring the means 18, 19 from their retracted position into their working position as a result of horizontal sliding transversely relative to the tie 1, the tie 1 then coming to rest on the common sheet 23, 47 against the projection or projections 56 and in line with the breaking member 24 and the movable jaw 49, on the one hand the common sheet 23, 47 has an edge 57 for the engagement of the tie 1 which is tapered, that is to say thinned in the manner of a cutting edge, and a smooth lower horizontal face. On the other hand, to make it easier for the common sheet 23, 47 to slide between the top face 4 and the tie 1, the device 16 also possesses means 58 acting mechanically on the bundle 2 and/or the tie 1, so as to move the tie 1 transversely and vertically apart from the bundle in order to generate the space 8.

These means 58 comprise, for example, in combination the means 17 for holding the bundle 2, in the active state, and a pusher 59 erected vertically downwards and terminating in a lower horizontal action surface 60 which, in the active position, is arranged slightly below the holding plane of the means 17 for holding the bundle 2. The vertical offset between the holding plane of the means 17 and the action surface 60 determines the depth of the dish forming the space 8. This offset depends on the degree of deformability of the bundle 2.

In a preferred first alternative version (as shown in the Figure), the pusher 59 is static and is composed simply of the column 29, the lower horizontal face of which forms the action surface 60.

In a second alternative version (not shown), the pusher is dynamic and possesses an action surface 60 displaced positively in relation to the column 29, especially by means of a jack carried by the column 29, vertically between its lower active position and an upper retracted position.

The device 16 just described can have a suspension piece 61 which in the first place supports rigidly and fixedly the means 17 for holding the bundle 2 and which in the second place supports the pusher 59, the general overall position of the means 17 for holding the bundle 2 and of the pusher 59 being fixed in a horizontal plane, and, which in the third place supports, on the one hand, an assembly 18, 19 for the breaking and holding of the tie 1, movable as a whole between the retracted and working general positions, and, on the other hand, the drive means 45, 53 of the assembly 18, 19 and the means for controlling these drive means.

Such a suspension piece 61 extending the column 29 vertically upwards is intended, for example, to be fastened to the head of a robot manipulator. Such a robot thus equipped with such a device 16 can form part of an apparatus for the feeding of blanks 3 to one or more magazines 13 of a machine, especially a packaging machine, the blanks 3 being stacked to form one or more bundles 2, each bundle 2 initially on the one hand being equipped with a tie, such as 1, and on the other hand being situated at a storage location 12 set apart from a distribution location 13.

Reference will now be made to FIGS. 2A to 2D and 3A to 3D which illustrate the process with regard to a device such as that described.

Initially (FIGS. 2A and 3A) the bundle 2 with its ties 1 is placed at the storage location 12, the top face 5 being free and horizontal. The device 16 is brought by the robot manipulator above the top face 5 and is moved (the arrow F1) towards the bundle 2 (the movements of the robot being programmed for this purpose), the means 17 being inactive (no vacuum in the suction cups), and the breaking means 18 and the means 19 for holding a tie being in their inactive and retracted positions.

Then (FIGS. 2B and 3B), the action surface 60 of the pusher 59 comes up against the central zone of the top face 4, at the same time pressing downwards on this (the arrow F2). The means 17 are activated (a vacuum in the suction cups). As a result of this, a space 8 is generated for each tie 1 (more specifically, each upper part 9 of each tie 1). The assemblies 18, 19 are moved in opposite directions from their inactive retracted positions to their inactive working positions as a result of sliding on the top face 4, the ties 1 being placed on the sheets 23, 47. These movements take place according to the arrows F3. These assemblies 18, 19 are then moved horizontally towards the outside of the top face 4, that is to say towards the side face 7.

Subsequently (FIGS. 2C and 3C), with the members, components, assemblies, etc. forming the device 16 remaining in their same positions, the device 16 is moved upwards (the arrow F4) in order to leave the storage location 12. The holding of the bundle 2 is ensured by the means 17 (suction cups under a vacuum) and also by the means 17, 18, more especially the sheets 23, 47 placed under the ties 1. This results likewise, under the load 2, in the generation of the falling space 26.

As a result of the movement of the device 16 actuated by the robot, the bundle 2 is then brought vertically in line with, but set apart from a magazine 13, a falling space 26 being preserved.

Subsequently (FIGS. 2D and 3D), the means 17 cease to be activated and the means 18, 19 are changed to their active position. The ties 1 are broken at the location of the breaking members 24, whilst at the same time being held at an end near the breaking zone by the means 19, and the blanks 3 are released from the means 17 and the ties and fall into the magazine 13 vertically (the arrows F5) because of their own weight. During this movement, the ties 1 are released at least partially from the bundle 2. If necessary, the end of the release is ensured by an especially ascending vertical moving apart of the device 16 and the magazine 13 (the arrow F6).

Thereafter, the means 18, 19 can be made inactive in order to free the ties 1 placed especially in a discharge zone.

The cycle can then begin again with another bundle 2 when the magazine 13 allows it or on another magazine 13.

As will be appreciated, the invention makes it possible to obtain flexible and automatic packaging lines operating at a higher rate and without manual handling.

I claim:

1. A process for breaking and removing a tie surrounding a bundle and arranged in a vertical plane by means of a device comprising means for holding the bundle, means for the transverse breaking of the tie having a plate, means for holding the tie and means for removing the broken tie from the bundle, the process comprising the steps of: holding the bundle with the tie to be broken and removed, creating a transverse spacing between the tie and an upper surface of the bundle by exerting two oppositely directed forces on the bundle to deform the upper surface of the bundle adjacent the tie, then positioning the breaking means into the vicinity of the tie of said bundle with the plate being between the upper surface and tie, and then simultaneously activating the breaking means in order to break the tie transversely, the means for holding and removing the broken tie and ceasing to hold the bundle so that the tie is broken and held as the bundle falls away from the held tie.

2. A process according to claim 1, wherein said step of holding the bundle suspends the bundle from above by vacuum suction and said step of ceasing interrupts said vacuum suction.

3. A process according to claim 1, wherein said means for the transverse breaking including one of the following means for shearing, means for puncturing and means for melting so that the step of activating said means for breaking selectively breaks the tie by one of the steps of shearing, puncturing and melting.

4. A process according to claim 1, wherein said means for holding the tie has a lower jaw and said step of positioning moves the lower jaw between the bundle and tie and includes gripping the tie on said lower jaw.

5. A process according to claim 4, wherein said step of creating a transverse spacing between the tie and an upper surface of the bundle has one of the two forces being a suspension force applied to several locations to suspend the bundle and the other force being a pressure action in the opposite direction, and the process includes moving the jaw with the plate between the tie and bundle.

6. A process according to claim 5, wherein said jaw and plate are first located adjacent the tie on a side with the other force and then shifted away from said other force to be inserted beneath the tie.

7. A process according to claim 1, which includes grasping the bundle at a storage location and transferring the grasped bundle to a distribution location prior to activating said means for breaking, so that the tie is broken and removed at the distribution location.

8. A process according to any one of claims 1–7 wherein the bundle has two ties and the step of activating the means for breaking and means for holding simultaneously breaks and removes both ties.

9. A process according to claim 8, wherein the two ties lie in parallel planes and divide the bundle into a middle zone and two lateral zones, said step of holding the bundle including supplying a suspension force to each end of the lateral zones and a pressure to the middle zone.

10. A process according to claim 9, wherein said bundle is a bundle of blanks for a packaging machine and the process includes moving the bundle over a magazine for the packaging machine prior to breaking the ties so that the bundle of blanks falls into the magazine as the ties are broken and removed.

* * * * *